US005297687A

United States Patent [19]

Freed

[11] Patent Number: 5,297,687

[45] Date of Patent: Mar. 29, 1994

[54] VIRTUAL HINGE

[76] Inventor: Anna B. Freed, 185 E. 85th St., Ste. 2-L, New York, N.Y. 10028

[21] Appl. No.: 850,029

[22] Filed: Mar. 12, 1992

[51] Int. Cl.[5] ..... B65D 55/02

[52] U.S. Cl. ..... 215/206; 215/220; 215/222; 215/223; 215/236; 215/245; 116/308; 116/324

[58] Field of Search ..... 215/206, 216, 217, 218, 215/219, 220, 222, 223, 230, 236, 238, 240, 245; 206/534; 116/308, 321, 323, 324

[56] References Cited

U.S. PATENT DOCUMENTS

| | | | |
|---|---|---|---|
| 3,587,896 | 6/1971 | Graff | 215/206 |
| 3,656,645 | 4/1972 | Fontenelli | 215/206 X |
| 3,765,578 | 10/1973 | Stull | 215/223 X |
| 3,766,882 | 10/1973 | Babbitt, III . | |
| 3,996,879 | 12/1976 | Walter | 116/308 |
| 4,238,033 | 12/1980 | Artzt | 206/534 |
| 4,365,721 | 12/1982 | Montgomery | 215/217 |
| 4,405,045 | 9/1983 | Villa-Real | 206/534 |
| 4,485,932 | 12/1984 | Kusz | 215/222 |
| 4,666,051 | 5/1987 | Trick | 215/230 |
| 4,739,890 | 4/1988 | Cooke | 215/222 |
| 4,749,093 | 6/1988 | Trick | 215/220 |
| 4,753,189 | 6/1988 | Mastman et al. . | |
| 4,913,083 | 4/1990 | Valvo et al. | 206/534 X |
| 5,011,032 | 4/1991 | Rollman | 215/230 |
| 5,040,691 | 8/1991 | Hayes et al. . | |
| 5,082,129 | 1/1992 | Kramer | 215/216 X |
| 5,083,671 | 1/1992 | Hayes | 215/245 |

FOREIGN PATENT DOCUMENTS

| | | | |
|---|---|---|---|
| 7437858 | 6/1976 | France | 215/223 |

*Primary Examiner*—Allan N. Shoap
*Assistant Examiner*—Stephen Cronin
*Attorney, Agent, or Firm*—Darby & Darby

[57] ABSTRACT

A dynamic virtual hinge closure used for controlled, reliable, and measured dispensing of a variety of substances with extensive compliance and child-resistance features. A hook integral with the container engages with a slot in a ledge of the lid to create a virtual hinge each time the closure is opened. The hook dynamically disengages with the slot each time the closure is closed. The lid can be hinged to open perpendicularly, horizontally, or vertically. The lid which opens vertically may include a pump device for dispensing liquids or sprays. A twisted elastic band may alternatively be used to function as the virtual hinge. Child-resistance can be accomplished with a pressure member which may be inserted into the lid. Monitoring is accomplished by markers positioned on one part of the external cylindrical front surface of the lid. A reversible lid, composed of only one part, provides for either side featuring any combination of the four possibilities, (i.e. A lid with-/without compliance and with/without child-resistance).

23 Claims, 6 Drawing Sheets

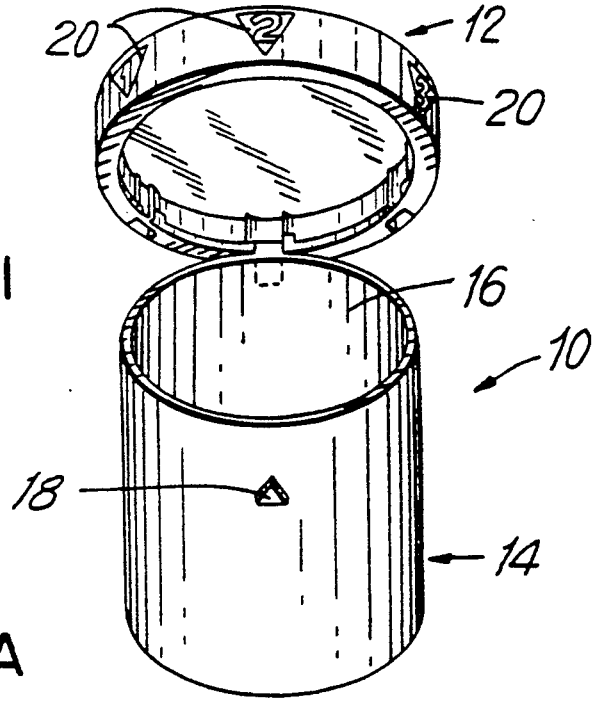
FIG. 1
FIG. 2A
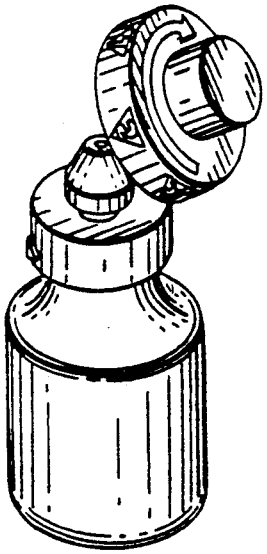
FIG. 2B
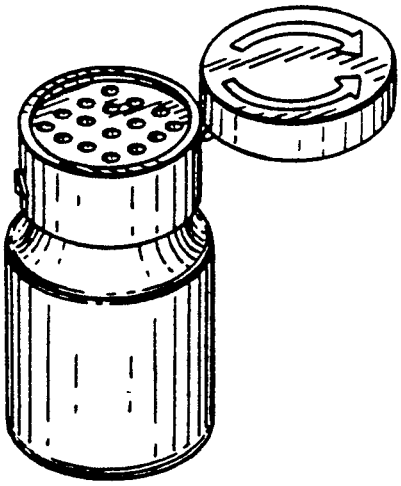
FIG. 2C
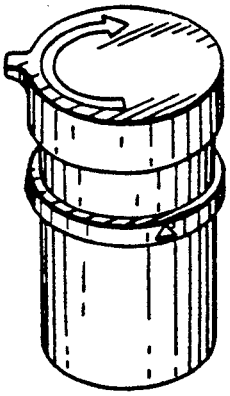

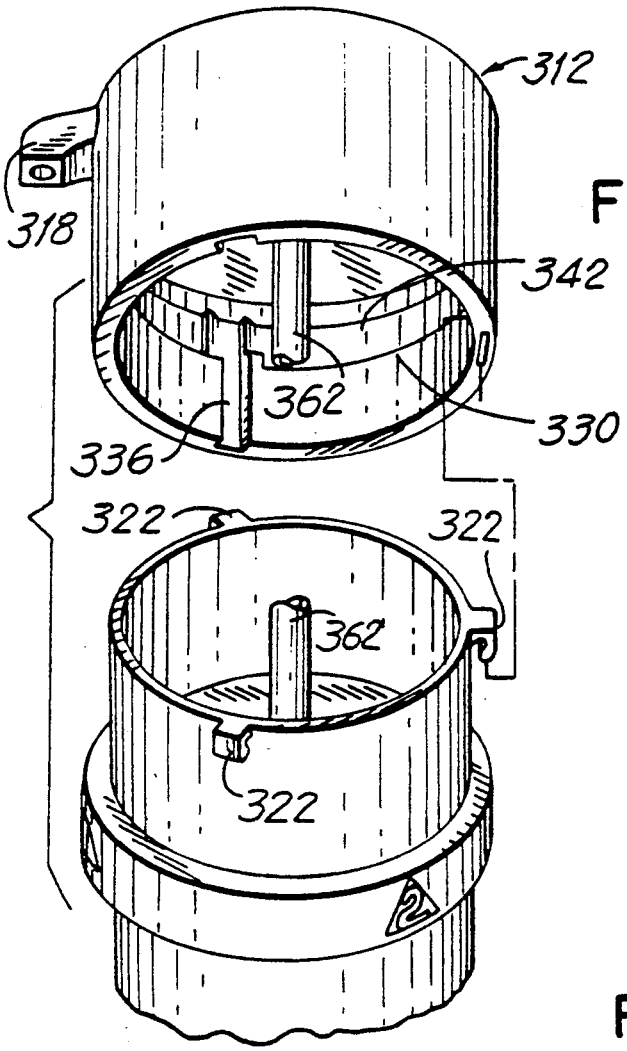
FIG. 13
FIG. 14
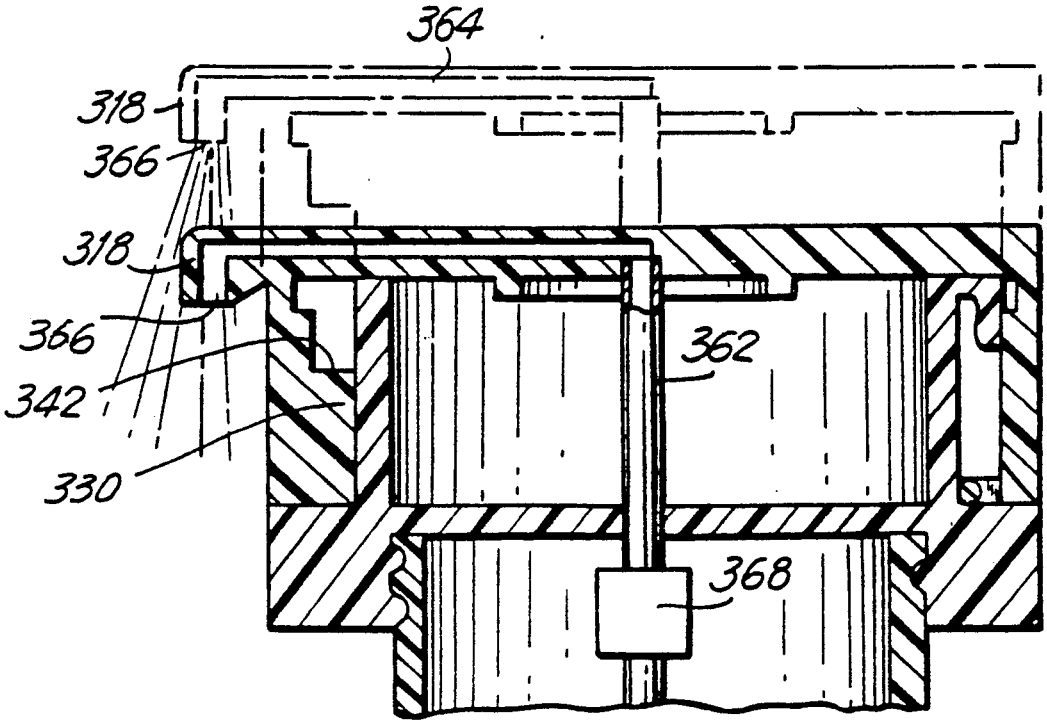

VIRTUAL HINGE

BACKGROUND OF THE INVENTION

1. Field of the Invention

The present invention relates to container closures, in particular, to a dynamically created virtual hinge closure which provides enhanced compliance utility for dispensers and containers.

2. Background Information

The present invention may be utilized in closures for food, cleaning products, toxic substances, drugs, lens covers, fertilizers etc.

This hinge may attach directly to a container or may attach to (or overlay) the top of an existing dispenser. The dynamic virtual hinge closure provides a synergistic effect when used to overlay dispensers such as pull-push, pumps,, tilt-top, roll-on, sponge-tip, sprays etc. Dynamic virtual hinge closures have extremely widespread utility.

An important current use is for both prescription and over-the-counter products. Recent demographic and sociologic changes in our society as well as medical advances have resulted in an increasing population of elderly as well as an increasing population of children in child-care facilities.

Many of the elderly are taking several medicaments, multiple times daily and the children in child-care facilities are often medicated by their daytime caretakers. These demographic and sociologic shifts, have resulted in increased incidence of noncompliance with prescribed medication regimens. The elderly, in addition to being the most likely to be impaired by poor memory, reduced visual acuity (including the blind), and diminished physical strength and dexterity, are usually taking a number of medicaments on a frequent basis, thus compounding the possibilities for serious harm to themselves. It is also important that child-care personnel have a simple way to determine whether particular children are due medication and also the dose amount.

Additionally, it is important for the parent to know whether the child has been given his/her medication during the parents absence. Although an improved compliance closure is especially required by both the younger and older population segments, everyone would benefit from an improved closure which remains attached to the container when opened, adapts easily for monitored dispensing and child-resistance, can be attached to a variety of existing dispenser types, is easy to use, simple to understand, durable, reliable, reusable, and also inexpensive to manufacture.

Four recent closures possessing many of these features have been disclosed by U.S. Pat. Nos. 4,749,093 to Trick; 4,753,189 to Mastman et al.; 4,913,083 to Valvo et al.; 5,040,691 to Hayes et al. These recently invented closures do not approach the comprehensive utility, structural simplicity, and reliability that is made possible by the dynamic virtual hinge of the present invention.

U.S. Pat. Nos. 4,749,093 to Trick and 4,753,189 to Mastman et al. each contain at least one additional and moving part. That part is located within the cap, contains the indicia, and cooperates rotatably within the cap. This invention advantageously does not contain any moving and/or additional parts or verbal indicia.

Unlike these related art references, the dynamic virtual hinge closure is uniquely independent. The virtual hinge closure can be configured about most existing dispensers such as nasal sprays or eye drops, to provide for monitored dispensing of a pre-measured liquid amount with optional child-resistance features. U.S. Pat. No. 4,913,083 to Valvo et al. must be replaced by the user in the proper position. Incorrect replacement could cause dispensing errors. The virtual hinge closure of the present invention dynamically attaches to the dispenser when opened, thus eliminating this problem.

U.S. Pat. No. 5,040,691 to Hayes et al. discloses a child-resistant closure. The hinge member 78,144 is fixed with respect to the skirt 73,142. Therefore, the hinge does not rotatably hold the lid 72,143 to the container in the closed position and compliance is not achieved.

These related art inventions function as child-resistant only. The present invention advantageously allows the user to switch this feature back and forth for repeated usage by different family members, while advantageously utilizing the familiar, already tested, motions of "PUSH DOWN and TURN", for child-resistance or "PULL UP and TURN" in a different child-resistant embodiment which requires less strength to open and only one part.

The related art closures require the pharmacist to stock and attach different caps and/or containers for different dispensing frequencies. The present invention advantageously utilizes both the same virtual hinge lid and container for different dispensing frequencies eliminating the need to dispense and maintain inventory of different lids and containers.

Unlike these related art closures, the dynamic virtual hinge closure of the present invention advantageously enables conversion to a child-resistant compliance closure for pre-configured over-the-counter dispensers and prescription containers, thus providing for the dispensing of different substance forms such as solids, liquids, powders and sprays.

SUMMARY OF THE INVENTION

The present invention provides a novel concept for dispensing systems by providing a dynamic virtual hinge lid for existing dispensers. The invention requires only two parts, a lid and dispenser/container. In one embodiment, an optional pressure member may be inserted within the lid if child-resistance is desired. The lid may be configured with or without monitoring features. Multiple marker-release sets provide for monitoring, whereas a single marker-release set provides for "as desired" dispensing.

In a first embodiment the lid lifts perpendicularly to the container and contains a pressure member for child-resistance. The embodiment is shown with four markers representing 4 times per day. In a second embodiment, rather than the lid being lifted perpendicularly to the container, the lid is arranged to "swing" in a horizontal plane while maintaining a fixed position relative to the pointer. This second embodiment is shown without the monitoring feature (i.e., there is only one marker and the lid rotates in either direction so the substance may be dispensed on an "as desired" basis). In a third embodiment, a elastic band functions as the "dynamic virtual hinge". The band is not visible, however when opened it creates tension which maintains the lid in a fixed position relative to the pointer. In a fourth embodiment, the entire lid can be lifted vertically. The liftable lid may contain a pump device within it. In a fifth embodiment, the lid is reversible, with one side of the lid possessing a child-resistance feature "PULL UP and TURN" and the reverse side containing no such feature.

An object of the present invention is to provide a useful and versatile lid which is reliable (no moving parts), inexpensive (only one part), and easy to manufacture (injection mold).

The present invention has only one required part besides the container, "the lid". The present invention requires fewer parts than any other known closures with these extensive features.

A further object of the present invention is to provide a simple lid that is independent of the dispenser and can be overlaid on any dispenser containing a hook. This virtual hinge feature may transform a dispenser to one with compliance and/or child-resistance capability. The lid is reusable, thereby saving money and addressing environmental concerns. The present invention advantageously uses either the standard, already tested, motions of "PUSH DOWN and TURN" or "PULL UP and TURN" motion requiring less strength, for child-resistance.

An object of the present invention is to provide a simple (one piece), and reliable (no moving parts) closure which aids user compliance. By using this invention, a user can readily monitor his/her own medication regimen, thus reducing medication errors, and also decreasing the involvement of health care professionals by providing a means for self medication for individuals who might otherwise need assistance due to reduced mental and/or visual acuity or impaired physical strength or dexterity.

A further object and novel concept of the present invention is to provide a single lid structure and design for different dispensing frequencies. This novel structure and design is comprised of a "front" which displays all the recessed markers, thus enabling the user to monitor "at a glance" his/her next dose. The user may also vary frequency by obscuring the unwanted recessed marker(s) with tape. Thus, the same lid may be used for different dose frequencies. For example, to create a 3/day dispenser, the user simply tapes over the 4th marker. To create a 2/day dispenser, the user tapes over the 3rd and 4th marker.

A further object is to provide a closure with extensive utility. The virtual hinge closure may be used for pet food, fertilizer, cosmetics etc. The dynamic virtual hinge closure may also serve as a receptacle, rather than a dispenser. such as food storage containers.

A still further object and novel concept of this invention is to integrate ergonomic design with the user's own kinesthetic senses to facilitate dispensing by creating a routine that is automatic and foolproof. With this ergonomic design a user is relieved from the necessity of reading often difficult to read instructions on the label each time he/she needs to make dispensing/dosage decisions. This is accomplished by the intermittent clicks prior to opening (to prevent skipping a dose) and after closing (to insure the lid is locked), the position of the pointer relative to the marker(s), and direction arrow(s) on top surface. In combination, these features, by integrating the senses of touch (recessed markers, raised pointer), motion (stopping), sound (clicking), and sight (pointer and markers on the "front") result in a habitual dispensing routine by maximizing the users own kinesthetic senses. Additionally, there are advantageously no verbal indicia, facilitating use by users who speak different languages, are illiterate, or blind.

Other objects, features and characteristics of the present invention, as well as the methods of operation and functions of the related elements of the structure, and the combination of parts and economies of manufacture, will become more apparent upon consideration of the following detailed description and the appended claims with reference to the accompanying drawings all of which form a part of this specification, wherein like reference numerals designate corresponding parts in the various figures.

BRIEF DESCRIPTION OF DRAWINGS

The invention will further be described with reference to the following drawings, in which:

FIG. 1 shows a perspective view of the Dynamic Virtual Hinge Closure;

FIG. 2A shows a perspective view of the hinge embodiment which lifts perpendicular to the container and is configured about a dispenser with a raised middle and markers on "the front";

FIG. 2B shows a perspective view of the hinge embodiment which swings in a horizontal plane and shows the lid with only one marker for dispensing substance "as desired";

FIG. 2C shows a perspective view of the hinge embodiment which lifts vertically and is configured about a pump;

FIG. 13 shows an exploded perspective view of another embodiment which would contain a pump dispenser within it and markers equally spaced about the circumference;

FIG. 14 is a cross-sectional view of FIG. 13 and shows the pump within it as a "black box" and the common screw type connection to the container;

DETAILED DESCRIPTION OF THE PRESENTLY PREFERRED EXEMPLARY EMBODIMENTS

Figure 3:
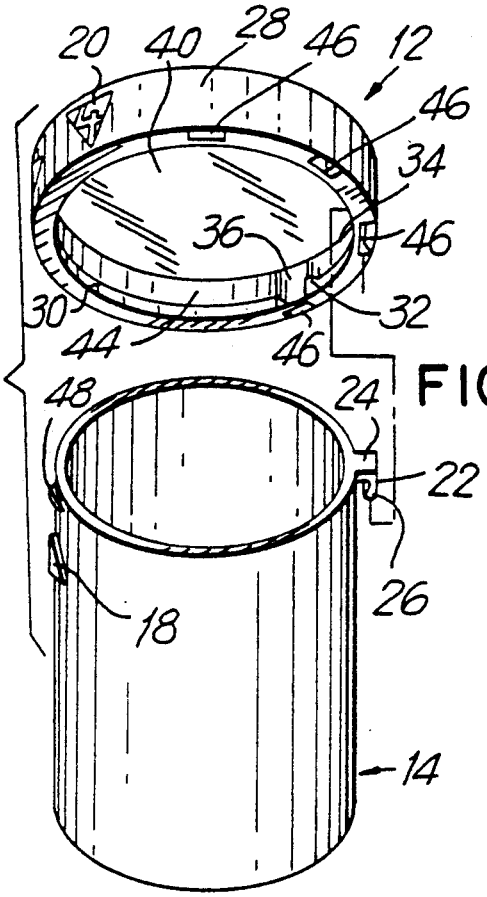
FIG. 3 shows an exploded perspective view of the lid and container, vertical ridges, boss, release channel within the lid, and hook and pointer on the container.

As shown in FIG. 1, a preferred embodiment of a virtual hinge in accordance with the present invention is designated generally by the reference character 10. As shown, the virtual hinge 10 includes a cylindrical lid 12 and a cylindrical container 14. The container includes a top port 16. The lid 12 is shown in the open and unlocked position in FIG. 1.

In the open position, the lid 12 is spaced from the port 16. A pointer 18 is integrally attached to the container 14. A plurality of markers 20 are positioned on an outer cylindrical surface of the lid 12. The markers 20 contain numerical indicia to indicate dose frequency.

Figure 10:
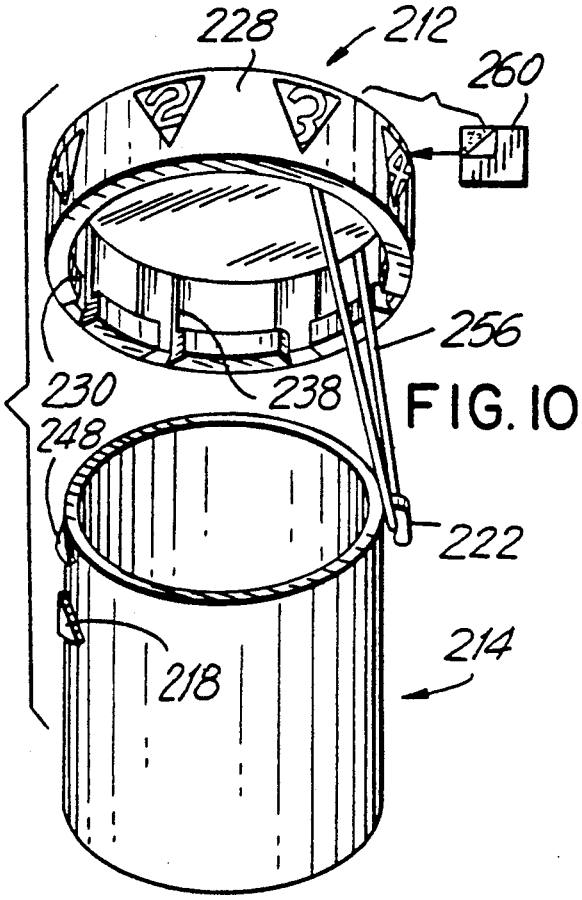
FIG. 10 shows an exploded perspective view of another embodiment in which a twisted elastic band serves as the virtual hinge.

As shown in FIG. 10, there are four markers with numerical indicia 1, 2, 3 and 4 being indicated. The markers are shown flush with the outer cylindrical surface of the lid 12. Of course, the markers could also be raised or recessed or contain no indicia whatsoever and just contain a raised or recessed indicator. The markers are shown on a front portion of the outer cylindrical surface of the lid 12. In the preferred embodiment, the markers are positioned on a portion of the outer cylindrical surface being less than 180 degrees so that the user can easily see or feel all the markers without rotating the container. Since most dispensing frequencies are four per day (or less), a lid having four markers is shown in the preferred embodiment. Of course, the lid could be constructed with six markers to accommodate frequencies of six per day (or less). The lid having four markers can be changed to a lid with 3 markers by providing a device to cover the view of the unneeded marker(s). For example, for three times per day, the fourth marker can easily be covered by a small piece of tape (see FIG. 10).

Similarly for 2 times per day, the fourth and third marker would be covered by tape.

In FIGS. 2A-2C, the virtual hinge closure is shown in various embodiments for use with various dispensers. In FIG. 2A, the lid is used with the type of dispenser that usually will contain a substance such as a liquid detergent.

FIG. 2B shows an embodiment where the lid will swing open in a horizontal direction for use with fish food or baby powder, etc.

FIG. 2C shows an embodiment with a container that is used as a pump dispenser. The fluid being pumped due to an up and down reciprocal motion of the lid. The structure and operation of the lid will be described in more detail below.

FIG. 3 shows an exploded view of the lid 12 and the container 14. The embodiment shown in FIGS. 3-5 includes a child-resistant mechanism in the form of a pressure member 40 for the lid. Alternately, if the pressure member 40 is removed from the lid, the closure can be constructed to be non child-resistant. The container 14 has a pointer 18 located diametrically opposite from a hook 22. The hook 22 is integral with the container 14 and includes a horizontal portion 24 which is substantially flush with the top cylindrical surface of the container 14 and a downwardly depending portion 26.

Figure 4A:
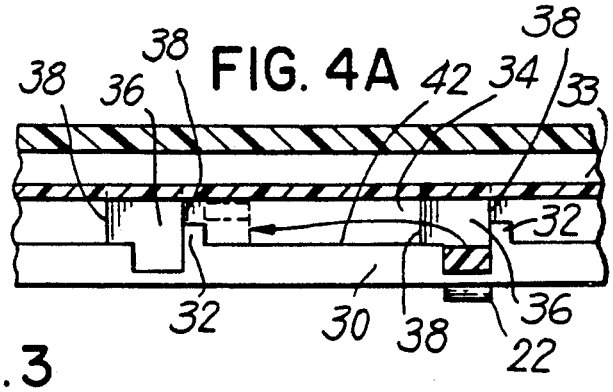
FIG. 4A shows a developed sectional view of the inner surface of the lid showing the "dynamic virtual hinge", the child-resistant pressure member and the hook moved from an unlocked position (in the release channel) to a locked position (above the ledge)
Figure 4B:
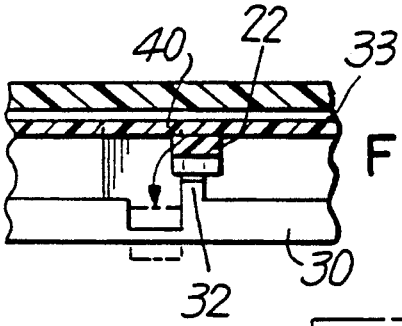
FIG. 4B shows a developed sectional view of the inner surface of the lid showing the hook compressing the pressure member upwards and passing above the boss on its way to an unlocked position.

The lid 12 includes a downwardly depending skirt 28. At the bottom portion of the skirt 28 is an inwardly projecting annular ledge 30. The ledge includes an upwardly projecting boss 32 as shown in FIGS. 3, 4A, and 4B. An inner cylindrical surface 34 of the depending skirt 28 is shown above ledge 30. A release channel 36 in contained in a portion of the inner cylindrical surface 34. The release channel 36 is defined by a pair of inwardly projecting vertical ridges 38. The vertical ridges are preferably shaped to prevent a reverse rotation of the lid 12 with respect to the container 14. A pressure member 40 is positioned inside an indentation 33 in the lid at its upper portion and cooperates with an annularly shaped downwardly depending skirt 35 to create the child-resistant mechanism.

Figure 5:
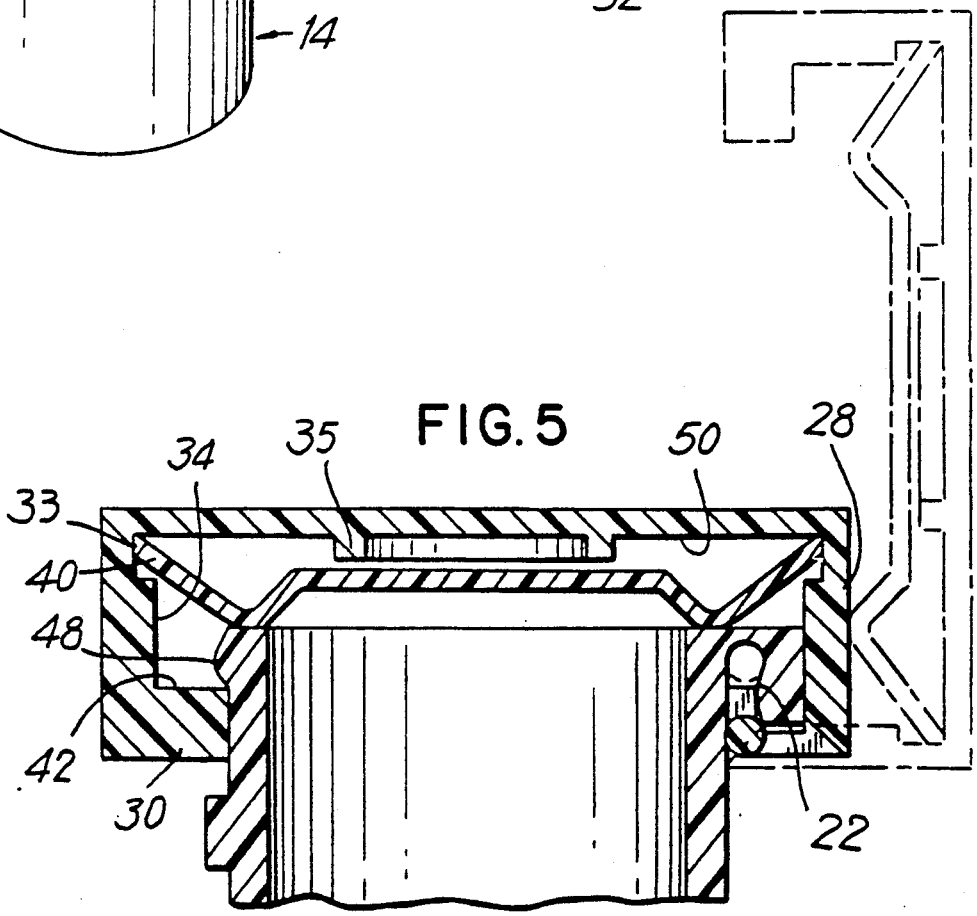
FIG. 5 is a cross-sectional view of the lid of FIG. 3 showing the child-resistant pressure member within the lid.

The operation of the container closure disclosed in FIGS. 3-5 begins with the lid 12 being connected to the container 14 as shown in FIG. 5. The hook 22 is above ledge 30 and adjacent to the inner cylindrical surface 34. The force from the pressure member 40 and annular skirt 35 keeps the lower surface of the hook 22 in sliding contact with the upper surface 42 of the ledge 30. Initially, the hook 22 is aligned with the area designated 44 as shown in FIG. 3. The lid is then rotated clockwise (as viewed from above the container) until the hook 22 engages a boss 32 which is located diametrically opposite the indicia containing numeral 1. The user will then push the lid down as shown in FIG. 4B until the bottom of the surface of the hook 22 is above the top surface of the boss 32. Then the user continues to turn the lid in a clockwise direction and the user will feel a click as the hook 22 passes over a vertical ridge 38. The user can then feel that the hook 22 is within the release channel 36 and between the two vertical ridges 38 (i.e. unlocked). Then the user pulls the lid straight up and the hook 22 engages with the slot 46 through the ledge 30. The user will feel another click as the hook 22 passes through the slot 46 and the lid 12 passes over the protruding rim 48. The user can now swing the lid open about the newly formed virtual hinge as shown in phantom in FIG. 5 and in FIG. 1.

After the desired substance has been dispensed, the user simply will close the lid onto the container by swinging the lid back down into the closed position. The inner cylindrical surface of the ledge 30 will again click over a protruding rim 48 on the outer cylindrical surface of the container. The protruding rim 48 on the container can be provided as an annular protrusion but is shown in the preferred embodiment only in the portion of the container near the pointer 18. Upon closing the lid, the user positions the lid back to the closed position and then pushes down on the lid so that the lid will click over the protruding rim 48 and the hook 26 will disengage from the slot 46 simultaneously. The user than turns the lid in the clockwise direction as shown by the arrow in FIG. 4A. The same procedure is repeated for the second dose, third dose and fourth dose. At this point, the container is ready to start the next day's cycle as the hook 22 is again aligned with the area 44.

Figure 8:
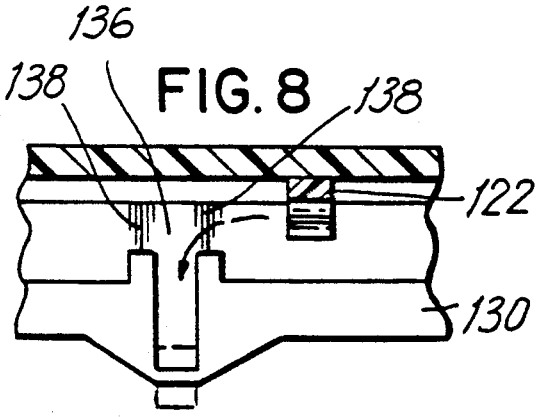
FIG. 8 shows a developed sectional view of the inner surface of the lid showing the "dynamic virtual hinge" with NO child-resistant pressure member and the hook moved from a locked position (above the ledge) to an unlocked position (in the release channel)
Figure 9:
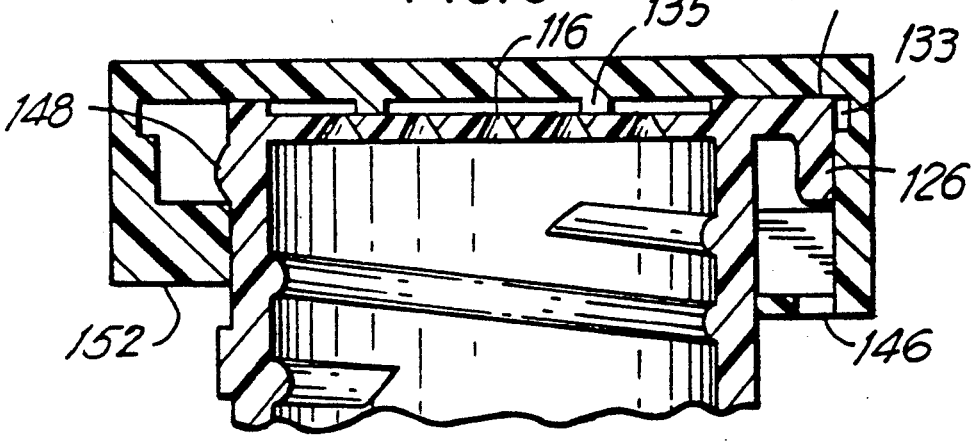
FIG. 9 shows a cross-sectional view of FIG. 7.

Removal of the pressure member 40 from the inside of the lid transforms the closure from a child-resistant closure to a non child-resistant closure. As shown in FIG. 8, the hook 22 is now in sliding contact with the bottom surface 50 of the lid 12 when the pressure member 40 is removed.

Upon rotation of the lid 12 with respect to the container, the hook will reach the ridge 38 and the user will feel the hook click into the release channel 36. To open the container, the user again pulls vertically up on the lid until the hook 22 engages with the slot 46.

The embodiment shown in FIGS. 6-9 correspond to the embodiment shown in FIG. 2B.

Figure 6:
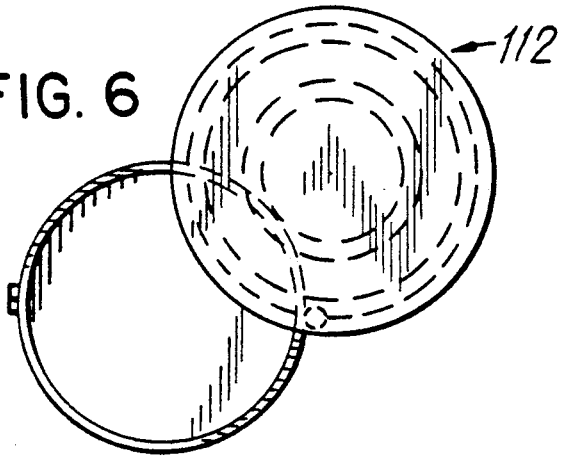
FIG. 6 shows a plan view of another embodiment of the lid which swings in a horizontal plane relative to the dispenser port.
Figure 7:
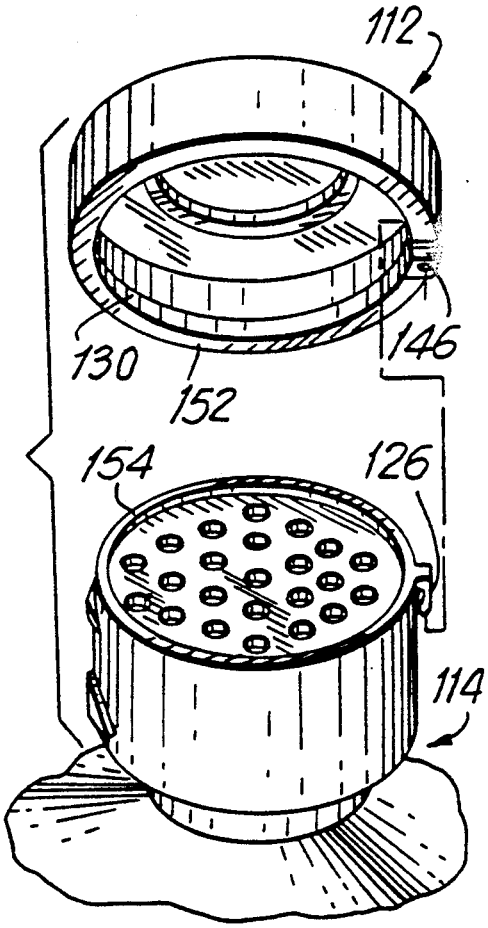
FIG. 7 shows an exploded perspective view of this swing embodiment configured about a dispenser containing a filter and one marker (i.e., "as desired" dispenser)

This embodiment allows lid 112 to swing horizontally to open the container 114. The slot 146 in the ledge 130 is formed as a circular slot in cross-section. The hook 126 is also of a circular shape in cross-section. The user can rotate the lid 112 with respect to the container 114 in the closed position, and can identify when the hook 126 is in the release channel 136 by feeling the hook click past either of the ridges 138. Then the user will simply pull up on the lid 112 until the hook 126 clicks past the slot 146 and the lid 112 clicks past the protruding rim 148. Thereafter the lid can swing horizontally to the open position as shown in FIGS. 2B and 6. The portion of the ledge 130 containing the slot 146 is positioned lower than the remaining portion of the ledge 130 to allow the lower surface of the ledge 152 to clear the top surface 154 of the container 114 when the lid swings horizontally to open the top port 116 of the container. The lid has one marker-release set permitting "as desired" dispensing. The vertical ridges 138 are shaped to allow the lid to rotate in both directions.

Figure 11:
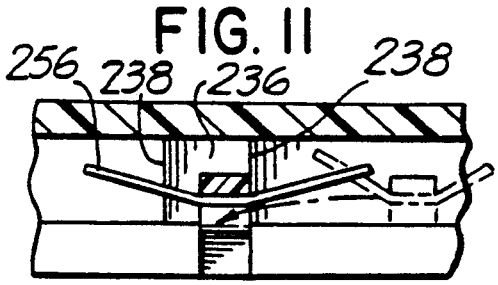
FIG. 11 shows a developed sectional view of the inner surface of the lid and the elastic band.
Figure 12:
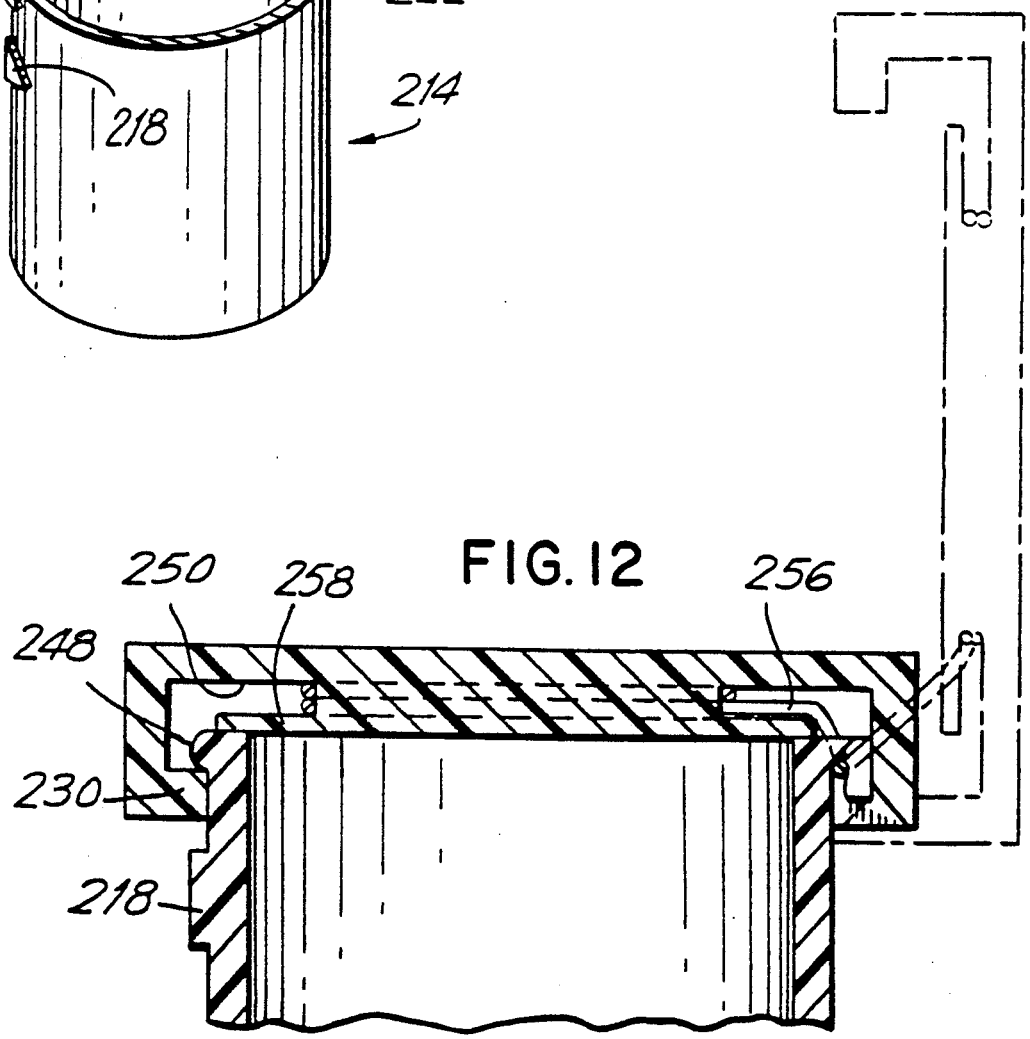
FIG. 12 is a cross-sectional view of FIG. 10 and shows the elastic band connection from the lid undersurface around "the spool" to the hook on the container.

The embodiment shown in FIGS. 10-12 includes a elastic band 256 that attaches the lid 212 to the container 214. A downwardly depending spool 258 is integrally attached to the bottom surface 250 of the lid 212. The elastic band 256 is wrapped around the hook 222 and is wrapped twice around the spool 258. The band 256 is twisted so that the cross over point for the band is located diametrically opposite from the hook 222. The tension force within the band 256 keeps the lid 212 attached to the container 214 when opened. The hook 222 is therefore in sliding contact with the upper surface of the inwardly projecting ledge 230 as shown in FIG. 11.

As the lid 212 is rotated with respect to the container 214, the hook 222 will click over a vertical ridge 238. The hook is then received in a release channel 236. The lid 212 can now swing up to the open position in the same manner as the lid swings in the embodiment shown in FIGS. 3-5. In FIG. 12 the lid is shown in phantom in the open position.

Also shown in FIG. 10 is a piece of opaque tape 260 which can be used to cover one or more indicia when a frequency of less than four per day are required. In the preferred embodiment, the indicia are recessed on the lid so that if opaque tape is used to cover the indicia, the tape will not protrude along the outer cylindrical surface of the depending skirt 228.

The embodiment shown in FIGS. 13 and 14 are to be used with a conventional pump dispensing unit 368. In this embodiment, the markers are equidistantly spaced around the circumference. The operation of the pump occurs when the three hooks 322 are selectively engaged in the three release channels 336 to allow the lid to reciprocate in the vertical direction. In the locked position the hooks 322 rest on the top surface 342 of the ledge 330 which prevents the lid from reciprocating in the vertical direction.

The fluid to be dispensed is allowed to travel up through the tube 362 and through a conduit 364 in the top surface of the lid 312 and out of the container through an outlet 366 in the pointer 318. Of course the embodiment shown in FIGS. 13 and 14 could be modified to be constructed with more release channels and hooks for greater dispensing frequency or with less release channels and hooks for lesser dispensing frequency.

As shown in FIGS. 13-14, the closure is non child-resistant. A pressure member can easily be inserted into the lid 312 to transform the closure into a child-resistant closure.

Figure 15:
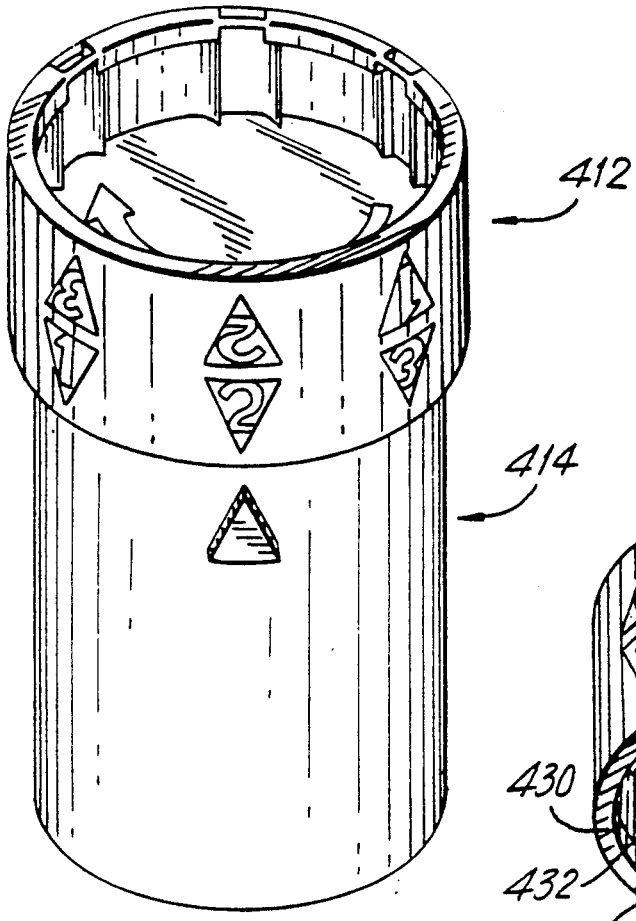
FIG. 15 shows a perspective view of the last embodiment which is reversible and shown utilizing the child-resistant feature.
Figure 16:
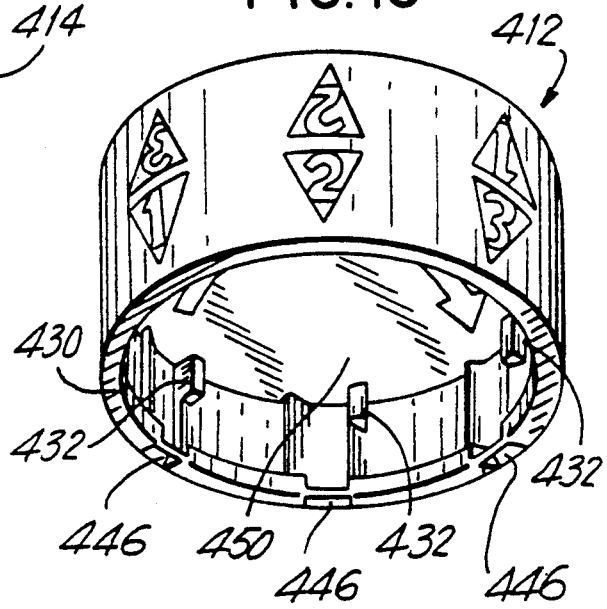
FIG. 16 shows a perspective view of the inner surface of the child-resistant side of the reversible lid.
Figure 17:
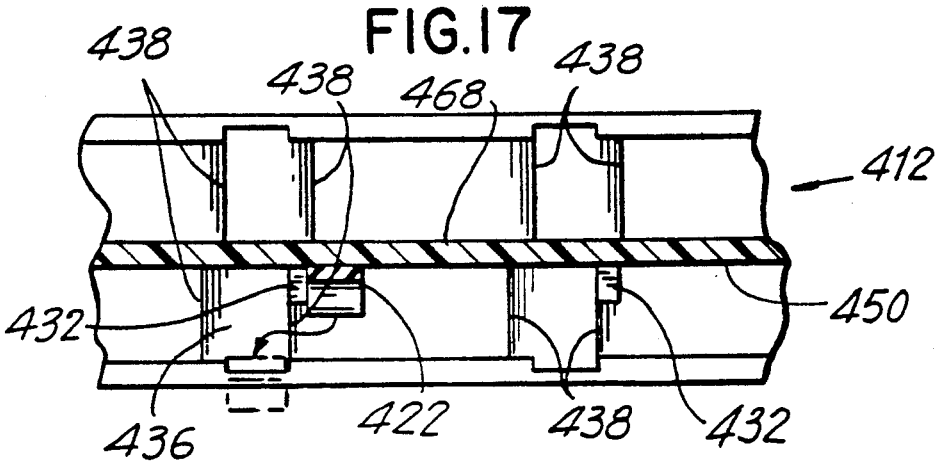
FIG. 17 shows a developed sectional view of the inner surface of the reversible lid wherein the upper part omits the child-resistant boss(es) and the lower part contains the child-resistant boss(es).

The embodiment shown in FIGS. 15-17 include a reversible lid that has a child-resistant side and a non child-resistant side. Only one part is required to satisfy requirements of a child-resistant and non child-resistant closure. In the embodiment shown in FIG. 17, the hook 422 slides along the bottom surface 450 of a central disk 468 of the lid 412.

During rotation of the lid, the hook 422 is in sliding contact with the surface 450. Upon rotation of the lid 412 in the clockwise direction with respect to the container 414, the hook 422 will eventually hit the boss 432. At this point, the lid must now be lifted or pulled up until the top surface of the hook 422 is below the bottom surface of the boss 432. The lid can now continue to be turned until the hook 422 clicks into the release channel 436. This motion is known as "PULL UP and TURN". At this point, the lid can then be lifted until the hook 422 engages with the slot 446 of the ledge 430. Thereafter, the lid 412 can swing up to open as shown in the embodiments of FIGS. 3-5 and 10-12.

To utilize the lid 412 as a non child-resistant closure, the lid is simply turned to its opposite side, that is, the side not containing the boss(es) 432, and the lid can be opened and closed without a "PULL UP and TURN" motion as in the child-resistant side. There are two advantages to the child-resistant feature as shown in FIGS. 15-17. 1) It does not require an additional part (i.e., pressure member) 2). It requires less strength to open the lid. The only force required to overcome for the "PULL UP" motion is that of gravity on the lid. Some users, especially the elderly, have great difficulty with the "PUSH DOWN and TURN" motion required of conventional child-resistant closures.

In the embodiment shown in FIGS. 3-5, with the child-resistant pressure member, the lid has recessed markers and the container has a raised pointer. The lid's inner cylindrical surface includes a ledge interrupted by a vertical release channel opposite each marker. A hook, which is integral with the container and opposite the pointer, rotates directly above the ledge when a pressure member is inserted or directly beneath the undersurface of the lid when the pressure member is omitted. When the lid contains a child-resistant pressure member, when the marker meets the pointer, the boss and hook engage, causing a halt in rotation, thus signaling the user to "Push Down and Turn" (FIG. 4A). The "Push Down" movement compresses the pressure member upward causing the hook to move up to a position above the boss thereby freeing the hook from the boss (see FIG. 4B). When the clockwise "TURN" is next made the hook passes above the boss and in front of the vertical ridge and into the release channel. The vertical ridge causes a click to be felt by the user, signaling that the closure is now unlocked. The user can now lift the lid for opening. This causes the hook to move down through the release channel and become engaged with a slot to form the virtual hinge (see FIG. 4B). The lid is now open and attached to the container with markers maintained in a fixed position relative to the pointer.

After the substance is dispensed, the lid is returned to its closed position, during which the previous process is reversed.

Specifically, as the lid returns to a horizontal position and is pushed down over the dispenser, the dynamic virtual hinge releases as the hook moves back up through the release channel to its prior position above the ledge. The user then turns the lid past the next inwardly projecting vertical ridge, (a second click is felt), thereby causing it to become locked. The pair of vertical ridges cause clicks to be felt on either side of the release channel and serve three purposes. 1) The ridges prevent reverse rotation. 2) The first ridge (click) indicates to the user that the lid is unlocked, positioned in the release channel, and ready to be opened. 3) The second ridge (click) indicates to the user that the lid has been locked.

The closure has been described as being in an open and closed position and as being in an unlocked and locked position. The closure is in the open position when the lid is spaced from the port of the container. The closure is in the unlocked position when the hook is in the release channel. The closure is in the locked position when the hook is above the ledge.

Although this invention has been described generally and in terms of a presently preferred exemplary embodiments, these should not be construed as limiting the scope of the invention. For example, the hook might have a different shape and still perform the same function of holding the lid to the container in a fixed position relative to the pointer. The release channel(s) may be dovetailed to better grip the hook. The marker(s) and/or pointer may have different shapes, be flat (rather than raised or recessed), and/or have no numerical indicia for reduced production costs. The "PULL UP and TURN" child-resistant feature of the reversible lid can of course be applied to any single sided lid which could be removed from the container.

The boss(es) could have a different shape. There could be markers for each day of the week, which could be equally spaced rather than on "the front". The configuration could be reversed, i.e., the hook could be on the lid and the markers and release channel on the container.

The vertical ridges may be modified or may be eliminated. Thus, the scope of this invention should be determined by the appended claims and their legal equivalents, rather than the examples given.

While the invention has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

What is claimed is:

1. A virtually hinged closure, comprising:

(a) a substantially cylindrical lid;

(b) a substantially cylindrical container, said lid being movable between a closed and an opened position, said closed position including a locked position and a released position, wherein in said locked position said lid is immovable to said opened position and in said released position said lid is movable to said opened position, said lid being rotatable relative to said container about an entire circumference of said container in said closed position only including in said locked position and in said released position;

(c) at least one marker position being associated with one of said lid and said container;

(d) pointer means for indicating said at least one marker position, said pointer means being associated with the other one of said lid and said container;

(e) locking means for rotatably locking said lid to said container in said closed position;

(f) selective release means for allowing selective release of said locking means; and (g) dynamic selective engagement means which dynamically cooperates with said selective release means for selectively engaging said lid to said container during movement of said lid from said closed to said opened position, said dynamic selective engagement means selectively fixing one of said at least one marker position with respect to said pointer means.

2. A virtually hinged closure according to claim 1 further including a removable pressure member disposed within said lid for selectively allowing said lid to be child-resistant and non child-resistant.

3. A virtually hinged closure according to claim 1 further including a means for permitting rotation of said lid with respect to said container in a first direction and for preventing rotation of said lid with respect to said container in a second opposite direction.

4. A virtually hinged closure according to claim 1 wherein said at least one marker position is located in a fixed angular relationship to said selective release means.

5. A virtually hinged closure according to claim 4 further including a downwardly depending skirt portion on said lid, at least one slot in one of said lid and said container, wherein said dynamic selective engagement means includes a hook attached to the other one of said lid and said container, said hook dynamically engaging with one of said at least one slot in said opened position.

6. A virtually hinged closure according to claim 4 further including a cylindrical portion depending downwardly from said lid, a ledge portion is adjacent to a bottom of said cylindrical portion.

7. A virtually hinged closure according to claim 1 further including a downwardly depending spool integrally attached to a bottom surface of said lid, a hook attached to the outer cylindrical surface of said container, wherein said dynamic selective engagement means includes an elastic band attached to said spool and said hook.

8. A virtually hinged closure according to claim 7 wherein said elastic band is wrapped around said spool at least twice.

9. A virtually hinged closure according to claim 1 wherein said lid includes a substantially central disk which divides said lid into a child-resistant side and a non child-resistant side.

10. A virtually hinged closure according to claim 9 further including at least one inwardly projecting boss attached to said lid and the top surface of said at least one boss being adjacent to said central disk on said child-resistant side.

11. A virtually hinged closure according to claim 10 wherein said child-resistant side of said lid is unlocked by pulling up and turning said lid.

12. A virtually hinged closure according to claim 1 wherein said at least one marker position comprises a plurality of marker positions positioned around an entire outer cylindrical surface of one of said lid and said container.

13. A virtually hinged closure according to claim 1 wherein said at least one marker position comprises a plurality of marker positions positioned on a portion of said outer cylindrical surface of one of said lid and said container.

14. A virtually hinged closure according to claim 1 further including at least one boss wherein said lid is unlocked by pulling up and turning said lid.

15. A virtually hinged closure, comprising:

(a) a substantially cylindrical lid;

(b) a substantially cylindrical container, said lid being movable between a closed and an opened position, said closed position including a locked position and a released position, wherein in said locked position said lid is immovable to said opened position and in said released position said lid is movable to said opened position, wherein in said closed position only, including in said locked position and in said released position, said lid is rotatable relative to said container about an entire circumference of said container;

(c) locking means for rotatably locking said lid to said container in said closed position and dynamically engaging said lid to said container in said opened position; and (d) selective release means for allowing selective release of said locking means.

16. A virtually hinged closure according to claim 15 wherein said locking means swingably engages said lid to said container in said opened position.

17. A virtually hinged closure according to claim 15 wherein said locking means reciprocally engages said lid to said container in said opened position.

18. A virtually hinged closure according to claim 15 further including a removable pressure member disposed within said lid for selectively allowing said lid to be child-resistant and non child-resistant.

19. A virtually hinged closure according to claim 15 wherein said lid includes a substantially central disk which divides the lid into a child-resistant side and a non child-resistant side.

20. A virtually hinged closure according to claim 19 further including at least one inwardly projecting boss attached to said lid and the top surface of said at least one boss being adjacent to said central disk on said child-resistant side.

21. A virtually hinged closure according to claim 20 wherein said child-resistant side of said lid is unlocked by pulling up and turning said lid.

22. A virtually hinged closure according to claim 15 further including an elastic band being attached to said lid and said container.

23. A virtually hinged closure according to claim 22 further including a spool integrally attached to a surface of said lid, a hook attached to said container, wherein said elastic band is attached to said spool and said hook.

* * * * *